US010157535B1

(12) United States Patent
Martinez

(10) Patent No.: US 10,157,535 B1
(45) Date of Patent: Dec. 18, 2018

(54) DOOR MOTION SENSOR AND REMINDER DEVICE

(71) Applicant: Jimmy Martinez, Elizabeth, NJ (US)

(72) Inventor: Jimmy Martinez, Elizabeth, NJ (US)

( * ) Notice: Subject to any disclaimer, the term of this patent is extended or adjusted under 35 U.S.C. 154(b) by 0 days.

(21) Appl. No.: 15/708,366

(22) Filed: Sep. 19, 2017

(51) Int. Cl.
*G08B 21/24* (2006.01)
*G08B 21/18* (2006.01)
*G08B 3/10* (2006.01)

(52) U.S. Cl.
CPC ..... *G08B 21/24* (2013.01); *G08B 3/10* (2013.01); *G08B 21/182* (2013.01)

(58) Field of Classification Search
CPC ..... G08B 21/24; G08B 13/08; G08B 3/10
See application file for complete search history.

(56) References Cited

U.S. PATENT DOCUMENTS 3,938,120 A * 2/1976 O'Connell ..... G08B 13/08 340/546
4,835,520 A 5/1989 Aiello
5,861,808 A * 1/1999 Lehmann ..... G08B 13/1436 340/309.7
6,104,288 A * 8/2000 Hopkins ..... G08B 3/10 340/545.1
7,113,091 B2 9/2006 Script et al.
7,119,681 B2 10/2006 Eskildsen
7,480,212 B1 * 1/2009 DuBreuil ..... G04G 11/00 368/28
7,821,386 B1 * 10/2010 Barrett ..... G06Q 10/10 340/457
7,880,613 B1 2/2011 Maeng
7,957,837 B2 6/2011 Zeigler
2004/0119600 A1 * 6/2004 Hampton ..... G08B 3/105 340/691.1
2004/0252011 A1 * 12/2004 Williams ..... H04L 51/24 340/3.3
2008/0256445 A1 10/2008 Olch et al.
2010/0315233 A1 * 12/2010 Eichenstein ..... E05B 45/06 340/542
2017/0337801 A1 * 11/2017 Robbins ..... G06Q 30/0261

* cited by examiner

*Primary Examiner* — Laura Nguyen
(74) *Attorney, Agent, or Firm* — Michael J. Feigin, Esq.; Feigin & Fridman

(57) ABSTRACT

A wireless reminder device affixed to a door determines that a person is walking through the door by way of using a motion detector. The device can also determine who is walking through the door based on how the door is moved or what handheld wireless transmission device is paired with, connected to, or providing the strongest signal to the reminder device. Such devices can include passive RFID, Bluetooth, or WiFi devices.

17 Claims, 4 Drawing Sheets

DOOR MOTION SENSOR AND REMINDER DEVICE

FIELD OF THE DISCLOSED TECHNOLOGY

The disclosed technology relates generally to door motion sensors and, more specifically, to a device which wirelessly receives and plays reminders as a person passes through a door.

BACKGROUND OF THE DISCLOSED TECHNOLOGY

Door mounted audio alerts function by alerting someone passing through the door of a message such as an alarm. Devices such as those disclosed in U.S. Pat. No. 6,104,288 work by determining when a device mounted on the door moves away from a device mounted on the door frame. When this happens, an alarm, such as a reminder to bring one's key, in this prior art patent, is made audible. U.S. Pat. No. 4,835,520 discloses another such device which functions by detecting when a door is open to a safe, by use of a switch.

One of the drawbacks of the prior art is that the accuracy of moving parts is relied upon. The door must open or close fully in order for a switch to be actuated between uses, the parts must remain lined up to each other between uses, and/or a switch has to continue to function properly after being moved. Moving parts break, rust, get covered by dirt and cease to function properly, and so forth. Further, such alarms are agnostic in terms of their message. The message cannot be tailored depending on which person is opening the door. Perhaps only, for example, a wife needs to be reminded to take her keys but a husband needs to be reminded to take the garbage out.

These and other limitations of the prior art are solved by embodiments described in the present disclosure.

SUMMARY OF THE DISCLOSED TECHNOLOGY

A door motion sensor and reminder device of embodiments of the disclosed technology has an attachment mechanism adapted to fix the device to a door. Such an attachment mechanism can be a screw, adhesive pad, nail and port for the nail, or the like. A wireless transceiver which is held to or within the device housing transmits and receives data electronically via radio waves. A motion detector, such as a mems sensor (Micro-electromechanical systems) detects motion of the device, and therefore, of the door on which the device is attached. A clock keeps track of the time and is updatable via data received through the wireless transceiver. A non-transitory storage medium stores at least one reminder associated with a specific time received via the wireless transceiver. A speaker plays back/is configured to play an audible version of the at least one reminder after the motion detector detects motion above a pre-defined threshold of movement. Such a pre-defined threshold is a threshold sufficient to indicate likely or actual purposeful movement of the door and can be calibrated to an amount of motion corresponding to opening the door enough such that a person can pass through or at an acceleration, velocity and/or distance of movement associated with a particular person's pattern of opening a door.

Reminders can be received from a first and a second handheld wireless transmission device. Thus, the device plays back reminders associated with the correct wireless transmission device and therefore, correct person associated with a respective one of the handheld wireless transmission devices. In order to do this, a determination is made as to which of the first and second wireless transmission device is associated with the present motion of the door, as detected by the motion sensor. In some embodiments of the disclosed technology, this is done by determining which wireless transmission device is paired with the wireless transceiver at a time the motion is detected. Being "paired with", "pairing", and the like refers to a handshaking process allowing two electronic devices to communicate with one another. Pairing links two computing devices together allowing for further communication. When a wireless transmission device is within radio communication range with the wireless transceiver, the pairing takes place in embodiments of the disclosed technology. When no device is paired with the wireless transceiver (which, for purposes of this disclosure, can include pairing with any device which sends or passes data there-through to a wireless transmission device), the last paired device is assumed to be associated with the motion of the door.

On other embodiments a determination as to which wireless transmitter (and user thereof) is associated with the door movement is based on detection of radio signal strength and length of continuation of the radio signal strength. Comparing this to past signal strength and length of time thereof can determine which user is passing through the door as different transmitters may have different transmission power, be blocked by obstacles (e.g. the person's body based on where on the body the device is worn), be at a different distance from the wireless transceiver on the door, or the like.

Other ways of determining which user is passing through the door (and therefore, which set of reminders to play) includes a determining a velocity of motion or length of time of the motion of the door as detected by the motion detector. That is, different users may tend to open the door at different speeds.

The "at least one reminder" can be multiple reminders whose time range of playback and number of playbacks are configured on a handheld wireless transceiver before the audible version is played. The handheld wireless transceiver transmits data sufficient for the device to determine the time range of playback (from when until when is a particular reminder made) and number of playbacks (maximum number of times the reminder is made) via the wireless transceiver. For example, a reminder may be played back at most once a day, only in the morning, or each time the person passes through the door.

The device can remain in low power mode until the motion sensor detects movement above the pre-defined threshold and/or a handheld wireless transmission device pairs with the wireless transceiver. After the handheld wireless transmission device pairs with the wireless transceiver an updated list of reminders and data associated with the reminders is sent to the device.

The device can be used by affixing a wireless reminder device to a door, entering data into a handheld wireless transmission device sufficient to cause the handheld wireless transmission device to pair with the wireless reminder device upon being within proximity thereof, entering at least one reminder into the handheld wireless transmission device to be sent to the wireless reminder device, and moving the door. Moving the door causes the wireless reminder device to audibly play a version of the reminder entered into the wireless transmission device.

Multiple reminders can be entered into the handheld wireless transmission device to be sent to the wireless reminder device, and which are sent in embodiments of the disclosed technology. The wireless reminder device plays back one or more of the multiple reminders based on a present time and a time associated with reminders of the multiple reminders which are played. One user of the reminder device can leave reminders for another user.

The wireless reminder device is configured, in embodiments of the disclosed technology, to make a determination if a reminder entered by the handheld wireless transmission device or a second handheld wireless transmission device should be played. This determination can be based on any of the factors described above, such as which wireless transmission device is closest to the door, which is paired with the reminder device, which has a stronger signal, and what is the speed of movement of the door.

Any device or step to a method described in this disclosure can comprise, or consist of, that which it is a part of, or the parts which make up the device or step. The term "and/or" is inclusive of the items which it joins linguistically, and each item by itself.

DETAILED DESCRIPTION OF EMBODIMENTS OF THE DISCLOSED TECHNOLOGY

A wireless reminder device affixed to a door determines that a person is walking through the door by way of using a motion detector. The device can also determine who is walking through the door based on how the door is moved or what handheld wireless transmission device is paired with, connected to, or providing the strongest signal to the reminder device. Such devices can include passive RFID, Bluetooth, or WiFi devices.

Embodiments of the disclosed technology are described below, with reference to the figures provided.

Figure 1:
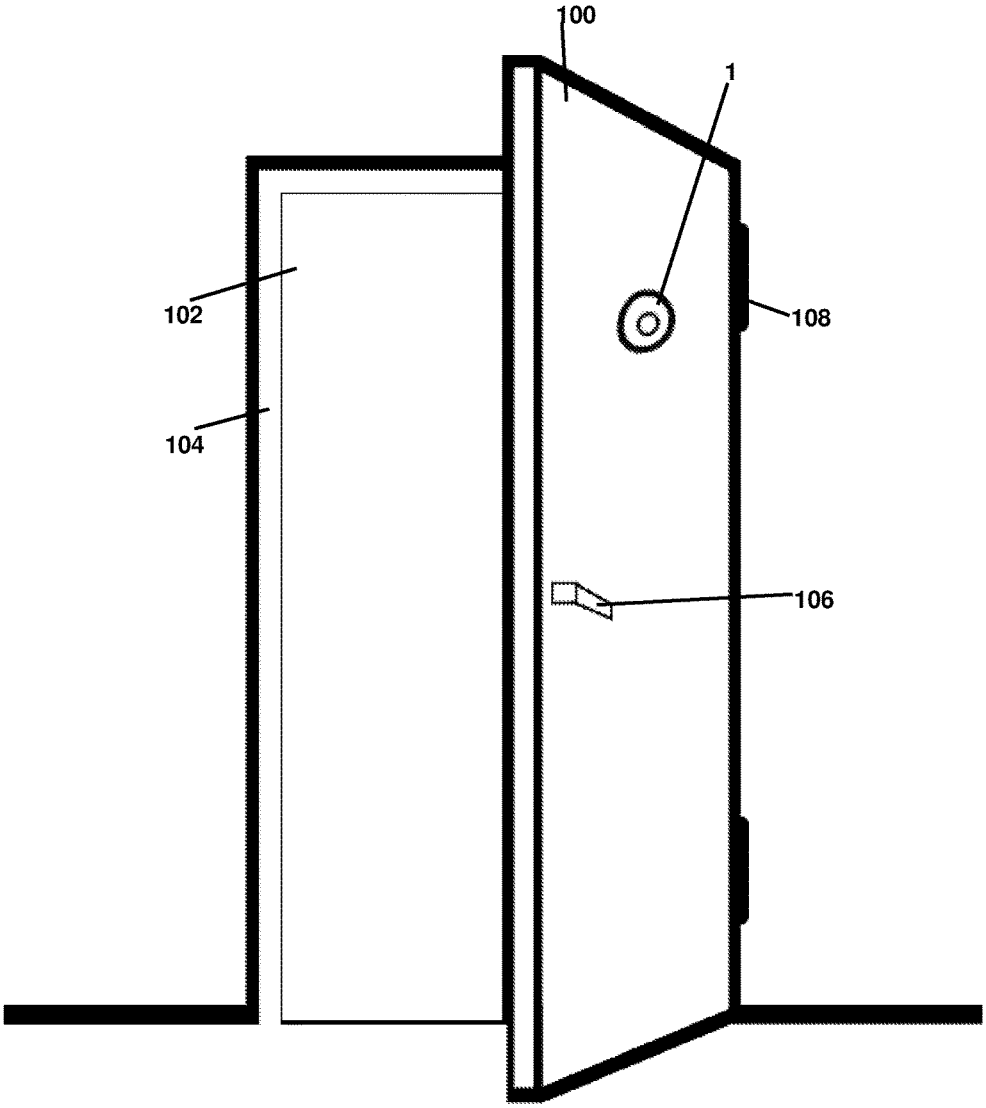
FIG. 1 shows the reminder device of embodiments of the disclosed technology affixed to a door.

FIG. 1 shows the reminder device of embodiments of the disclosed technology affixed to a door. The door 100 is attached to a wall or another structure by hinges 108 or another attachment mechanism which allows the door to rotate with respect to a fixed object. This rotational motion is detected by a motion sensor within a reminder device 1. The door further can have a handle 106 for aiding in moving the door and an infrared or other sensor can be directed from the reminder device 1 towards the handle 106 to determine motion thereof. Or, the vibration of the handle 106 can be detected by the motion detector within the reminder device 1. In any case, movement of either the handle 106, hinge (relative to the reminder device 1) or the door 100 itself is sent to a processor within the reminder device 1. The precise motion, such as the velocity of motion, acceleration, or length of time of the motion can be used to determine which person is moving the door 100, as described in more detail with respect to FIG. 3. Further, the door closes a portal 102 in embodiments of the disclosed technology and can align with a door frame 104 which is fixed in position relative to the door.

Figure 2:
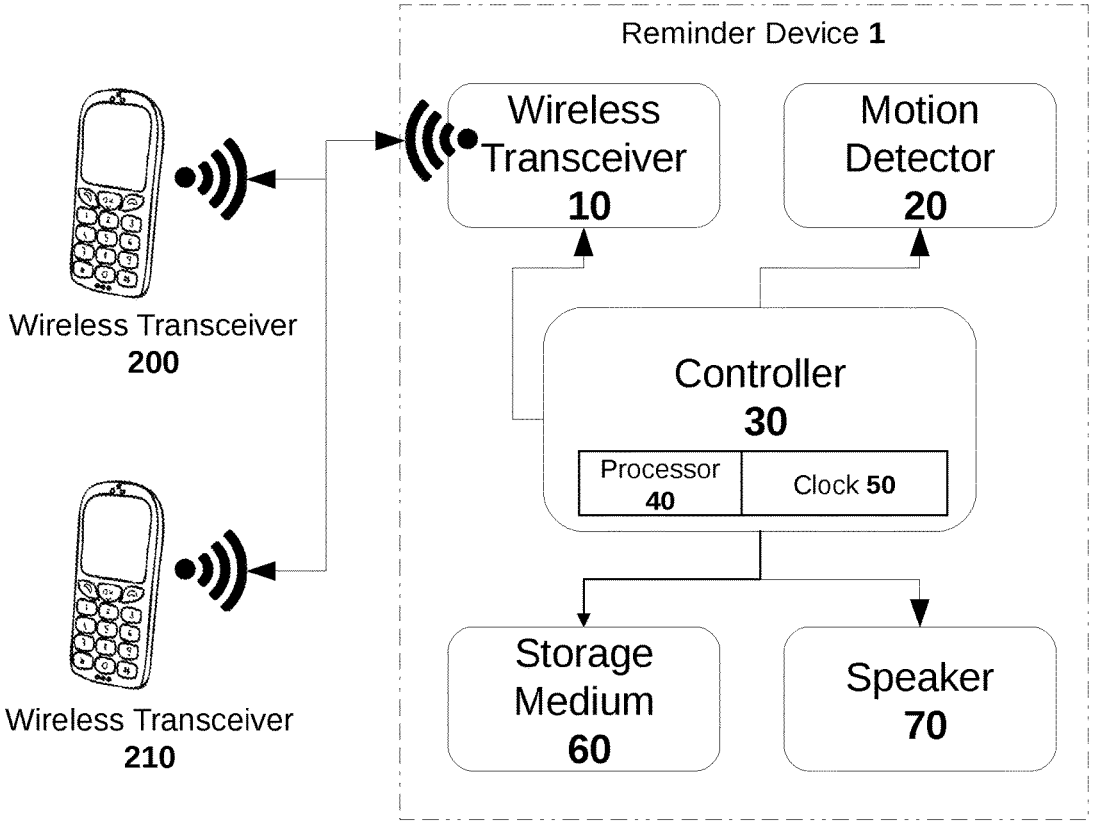
FIG. 2 is a high-level block diagram of the reminder device and wireless transceivers used to carry out embodiments of the disclosed technology.

FIG. 2 is a high-level block diagram of the reminder device and wireless transceivers used to carry out embodiments of the disclosed technology. Handheld wireless transmission devices 200 and/or 210 are used to communicate with the reminder device. The handheld devices 200/210 have a processor and other elements described with reference to FIG. 4. Each of these can be used to input reminders for a specific user, for any time the door 100 is opened/closed, or for sending as a reminder for another user when the door is opened. These devices communicate wirelessly with the wireless transceiver 10 within the reminder device 1. This can be accomplished using 802.11 WiFi, Bluetooth, passive RFID (radio frequency ID) or another wireless radio frequency transmission mechanism. The handheld wireless transmission device 200 and/or 210 can be paired with the reminder device 1. Whenever the devices are within radio frequency range of each other, the pairing can take place by way of automated processes. With passive RFID, pairing does not take place, but at close range a particular RFID circuit can be detected which has previously been associated with a specific user/person in addition to or instead of their handheld wireless transmission device.

The reminder device 1 itself has multiple parts including not only the above-described wireless transceiver 10 but also a controller with a processor 40 which carries out instructions read into memory from a storage medium, such as the storage medium 60. A clock 50 can refer to one of a processor clock or a clock which maintains the present time as the reminders can be time-based (made only at certain times). A speaker 70 exhibits audio versions of the reminders after the motion detector 20 detects motion of the reminder device 1 and/or motion of the door 100.

Figure 3:
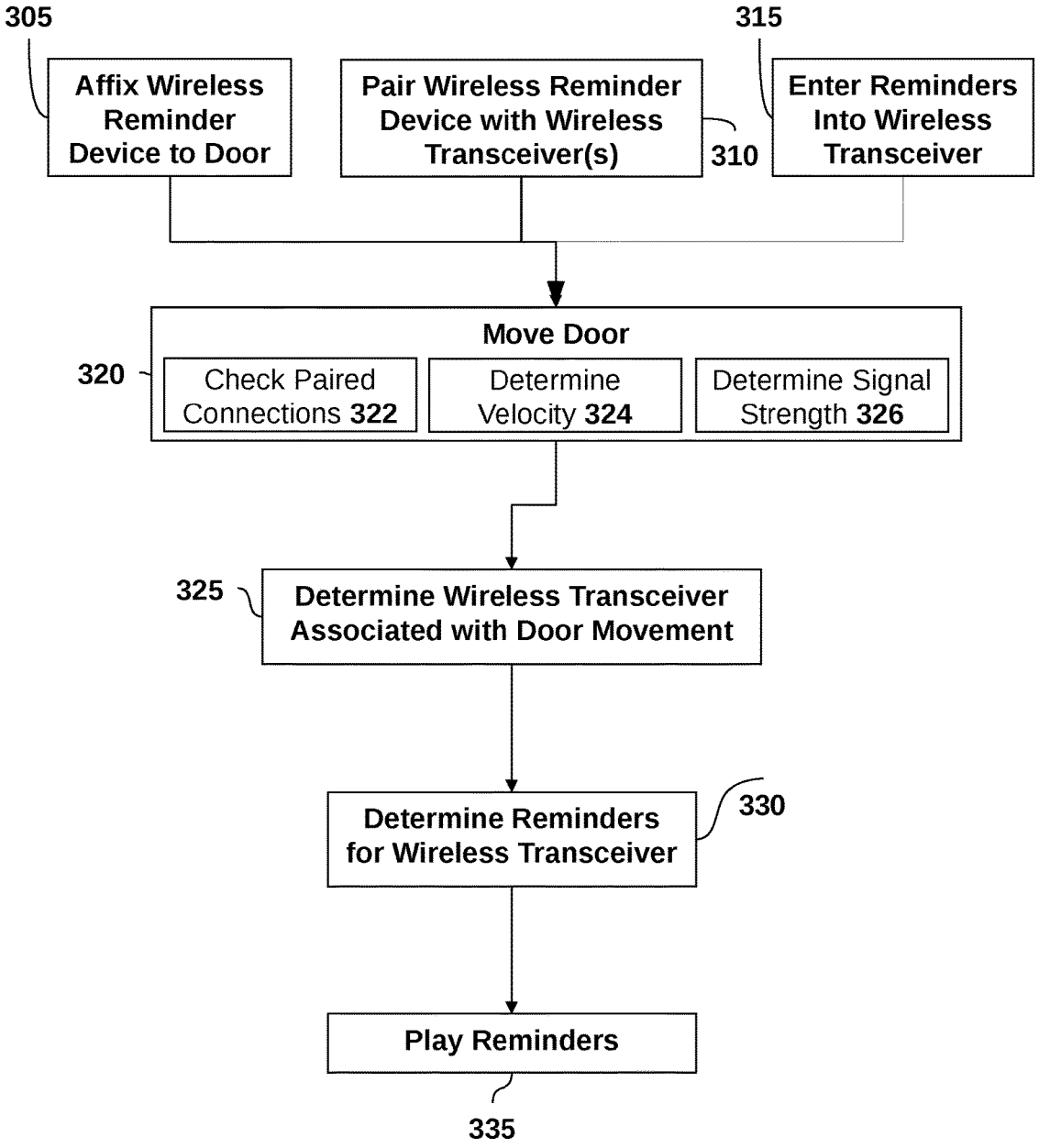
FIG. 3 is a flow chart showing a method of carrying out embodiments of the disclosed technology.

FIG. 3 is a flow chart showing a method of carrying out embodiments of the disclosed technology. Steps 305, 310, and 315 can take place in any order or concurrently. The wireless reminder device 1 is affixed to a door 100 in step 305 and paired with a one or more wireless transceivers in step 310. Reminders are then entered into the wireless transceiver in step 315 (e.g. the handheld wireless device) where data sufficient to reconstruct the reminder is transmitted and/or stored within the reminder device, such as within the storage medium 60. Reminders stored can be associated with a specific user and/or a specific handheld wireless transceiver. Each specific wireless handheld transceiver has a device address such as a MAC address when using 802.11 WiFi or a Bluetooth identifying number or name of the device when using Bluetooth. Reminders sent to the reminder device 1 can then be associated with the device which uploaded the reminder or a device selected by user to receive the reminder. Further, reminders can be time-bound with delivery designated only between a specific start and finish time (e.g. between 7 am and 10 am each day, 7 am and 10 am on a specific day only, or the like). A multitude of reminders can also be played back at one time (in step 335).

Returning now to FIG. 3, in step 320 the door is moved. Until the door is moved, such as after a period of inactivity (defined as either a period of time when there is no detected door movement and/or no detected devices in range wirelessly) the reminder device can enter a low power mode to conserve battery power. In such a mode, only wireless discovery is operational or the reminder device is powered down excepting for the motion detector which wakes the device upon detection of movement. Once the door is moved, any of steps 322, 324, and/or 326 are carried out. In step 322, paired connections are checked for which can include trying to connect with handheld wireless devices detected to be within range. Even without actually pairing with such other devices, the detection of the presence of such devices (as determined by their unique identifiers, signal strength or power (in decibels), or the like can determine that a device (or which device) is associated with a person who is moving the door in step 325.

Elucidating further on step 320, different handheld wireless transceivers 200 and 210 may have different detectable patterns to determine one from another. One may transmit at a different power, transmit a different code, or typically be held in a different place (lower down towards the floor and away from the reminder device 1 than another device which perhaps is held in a shirt pocket instead of on a belt buckle). As such, this information can be used to determine which device is passing through the door. Still another way of making this determination is by determining how fast the door 100 is moving. One user may open the door much faster than another thereby creating a higher initial acceleration. One user/person might also tend to open the door further than the other. Using any of these methods, alone or in combination, it can be determined which wireless transceiver 200 or 210, and thereby, which person (who is assumed to be carrying the same handheld wireless transmitter) is passing through the door.

In step 335, the reminders stored and associated with a detected handheld wireless device 200/210 are played proximate in time (e.g. within 10 seconds, 5 seconds, or 2 seconds) of the door being moved in step 320. The reminders played can be a series of repeated reminders every time, or one per day, that a person passes through the door. The reminders can also be designated for one person and their associated device, but send by another person. For example, a wife may have a reminder for her husband to take the garbage out the next time, or every morning, when front door movement is detected. This can be with or without detection of the presence of the husband's wireless transmitting device or husband at the time the door is moved. Likewise, the husband might set a reminder for the wife to turn the lights off before she leaves the house.

Referring back to step 315, the step of entering reminders takes places at a different and non-proximate time (defined as more than fifteen minutes apart) from the time the door is moved in embodiments of the disclosed technology. These reminders are then uploaded to the reminder device 1 when the handheld wireless transmission device (e.g. device 200 or 210) is paired with or connects to the reminder device 1. In the low power mode, in order that the reminders stay up to date, the device might come out of lower power mode at regular intervals such as every three or six hours. In this manner, even if the person and his/her associated wireless device do not pass through the door 1 during this period of time or pass too quickly for the (complete) exchange of data to take place, this helps keep the data on the reminder device 1 up to date.

A person, for example, who sleeps within wireless range of the reminder device 1 could then have their reminder device be updated at least nightly with the new information. So too, reminders may be passed via a packet switched network, such as the wide area network known as the "Internet" to pass reminder information for multiple users of a specific reminder device 1. In this manner, any handheld wireless transmission device 200/210 could update reminders for all the other devices, or a wireless router, wireless hotspot, or the like can be at the location of the reminder device 1 can send updated data about reminders and users to the reminder device 1 at time intervals such as one per day or every six hours.

Figure 4:
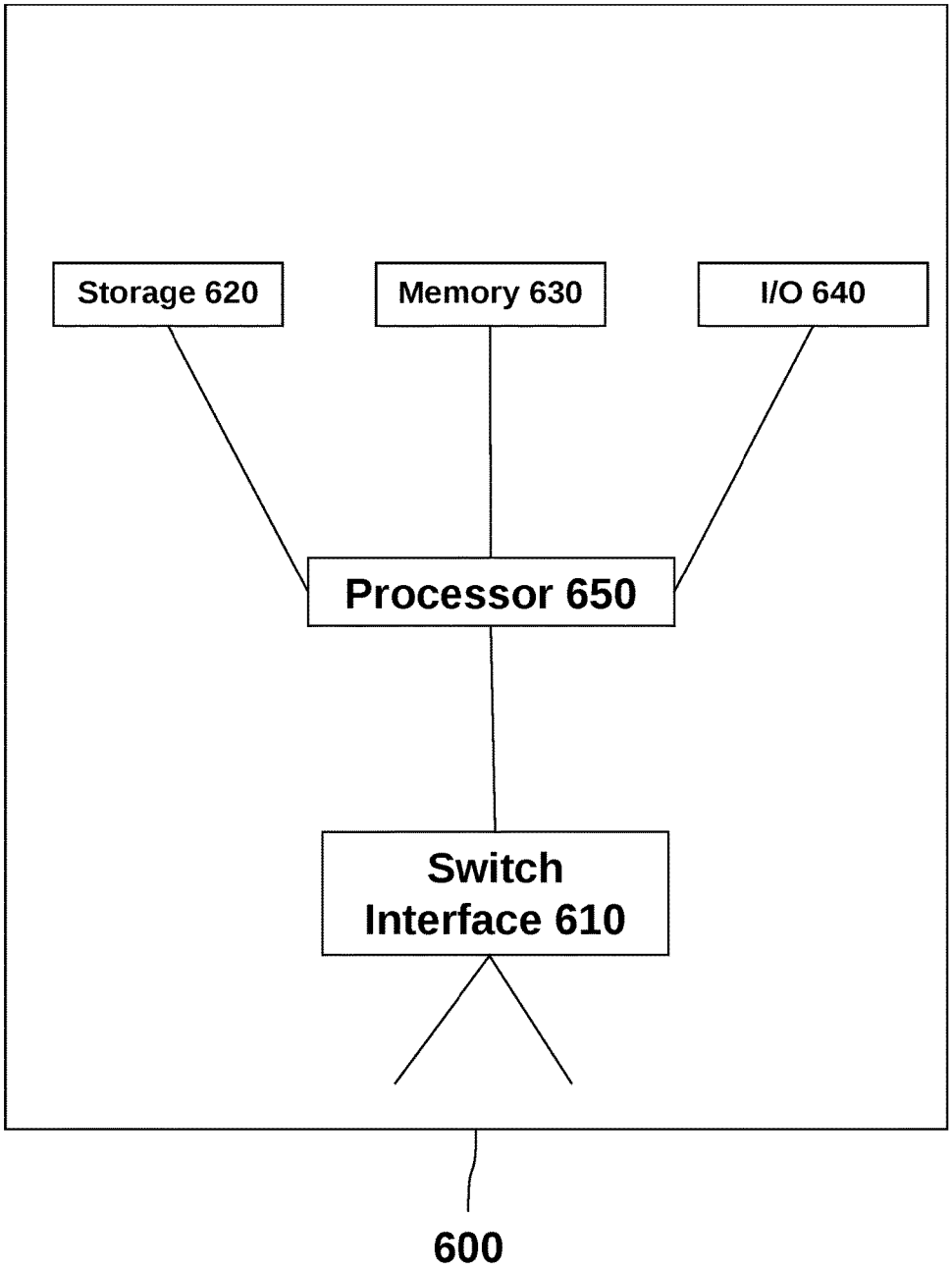
FIG. 4 is a high-level bock diagram of devices used to carry out embodiments of the disclosed technology.

FIG. 4 shows a high-level block diagram of a device that may be used to carry out the disclosed technology. Device 600 comprises a processor 650 that controls the overall operation of the computer by executing the device's program instructions which define such operation. The device's program instructions may be stored in a storage device 620 (e.g., magnetic disk, database) and loaded into memory 630, when execution of the console's program instructions is desired. Thus, the device's operation will be defined by the device's program instructions stored in memory 630 and/or storage 620, and the console will be controlled by processor 650 executing the console's program instructions. A device 600 also includes one, or a plurality of, input network interfaces for communicating with other devices via a network (e.g., the Internet). The device 600 further includes an electrical input interface. A device 600 also includes one or more output network interfaces 610 for communicating with other devices. Device 600 also includes input/output 640, representing devices which allow for user interaction with a computer (e.g., display, keyboard, mouse, speakers, buttons, etc.). One skilled in the art will recognize that an implementation of an actual device will contain other components as well, and that FIG. 4 is a high level representation of some of the components of such a device, for illustrative purposes. It should also be understood by one skilled in the art that the method and devices depicted in FIGS. 1 through 3 may be implemented on a device such as is shown in FIG. 4.

Further, it should be understood that all subject matter disclosed herein is directed, and should be read, only on statutory, non-abstract subject matter. All terminology should be read to include only the portions of the definitions which may be claimed. By way of example, "computer readable storage medium" is understood to be defined as only non-transitory storage media.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A door motion sensor and reminder device comprising:

an attachment mechanism adapted to fix said door motion sensor and reminder device to a door;

a wireless transceiver;

a motion detector;

a clock;

a non-transitory storage medium storing at least one reminder associated with a specific time received via said wireless transceiver, wherein said non-transitory storage medium comprises reminders received from a first and a second handheld wireless transmission device;

a speaker configured to play an audible version of said at least one reminder after said motion detector detects motion above a pre-defined threshold of movement, wherein a determination is made as to which said first and said second wireless transmission device is associated with said motion.

2. The door motion sensor and reminder device of claim 1, wherein said determination is made based on which said first and said second wireless transmission device is paired with said wireless transceiver at a time said motion is detected.

3. The door motion sensor and reminder device of claim 1, wherein said determination is made based on which said first and said second wireless was last paired with said wireless transceiver prior to a time said motion is detected.

4. The door motion sensor and reminder device of claim 1, wherein said determination is made based on detection of radio signal strength and length of continuation of said radio signal strength associated with only one of said first or said second wireless transmission device.

5. The door motion sensor and reminder device of claim 1, wherein said determination is made based on a velocity of motion of said door as detected by said motion detector.

6. The door motion sensor and reminder device of claim 5, wherein said determination is further made based on a length of time of said motion of said door as detected by said motion detector.

7. The door motion sensor and reminder device of claim 1, wherein said determination is made based on which of said first or said second wireless transmission device has a stronger signal strength as detected by way of said wireless transceiver.

8. The door motion sensor and reminder device of claim 1, wherein said at least one reminder comprises multiple reminders whose time range of playback and number of playbacks are configured on a handheld wireless transceiver before said audible version is played, said handheld wireless transceiver transmitting data sufficient for said door motion sensor and reminder device to determine said time range of playback and number of playbacks via said wireless transceiver.

9. The door motion sensor and reminder device of claim 1, wherein said door motion sensor and reminder device remains in a low power mode until one of either:

said motion sensor detects movement above said predefined threshold; or a handheld wireless transmission device pairs with said wireless transceiver.

10. The door motion sensor and reminder device of claim 9, wherein after said handheld wireless transmission device pairs with said wireless transceiver an updated list of reminders and data associated with said reminders is sent to said door motion sensor and reminder device.

11. A method of automating reminders, comprising:

affixing a wireless reminder device to a door;

entering data into a handheld wireless transmission device sufficient to cause said handheld wireless transmission device to pair with said wireless reminder device upon being within proximity thereof;

entering at least one reminder into said handheld wireless transmission device to be sent to said wireless reminder device;

moving said door causing said wireless reminder device to audibly play a version of said reminder entered into said wireless transmission device, and configuring said wireless reminder device to make a determination if a reminder entered by said handheld wireless transmission device or a second handheld wireless transmission device should be played;

wherein said determination is based on proximity of said handheld wireless transmission device or said second handheld wireless transmission device for said door.

12. The method of claim 11, comprising a step of entering multiple reminders into said handheld wireless transmission device to be sent to said wireless reminder service.

13. The method of claim 12, wherein said wireless reminder device plays back one of said multiple reminders based on a present time and a time associated with reminders of said multiple reminders which are played.

14. The method of claim 11, wherein proximity is determined based on which of said wireless transmission devices is paired with said wireless reminder device.

15. The method of claim 11, wherein proximity is determined based on a speed of movement of said door associated with one of said wireless transmission devices.

16. The method of claim 11, wherein proximity is determined based on a stronger signal strength between said wireless reminder device and one of said wireless transmission devices.

17. The method of claim 11, wherein at least one reminder entered into said handheld wireless transmission device is associated with said second handheld wireless transmission device, and said at least one reminder is played when a person other than one carrying out said steps of said method moves said door.

* * * * *